United States Patent [19]

Nazem et al.

[11] Patent Number: 4,511,625

[45] Date of Patent: Apr. 16, 1985

[54] PHYSICAL CONVERSION OF LATENT MESOPHASE MOLECULES TO ORIENTED MOLECULES

[75] Inventors: Faramarz Nazem, Strongsville; Rostislav Didchenko, Middleburg Heights, both of Ohio; David Fink, Stamford, Conn.

[73] Assignee: Union Carbide Corporation, Danbury, Conn.

[21] Appl. No.: 429,186

[22] Filed: Sep. 30, 1982

[51] Int. Cl.[3] ..... C10C 3/18; D01F 9/14; D01D 1/04; D01D 5/08

[52] U.S. Cl. ..... 428/401; 208/22; 264/29.2; 264/176 F; 264/DIG. 19; 423/447.2; 423/447.4; 423/447.6; 425/197; 425/461

[58] Field of Search ..... 264/176 F, 29.2; 208/3-7, 39, 22; 423/447.1-447.6

[56] References Cited

U.S. PATENT DOCUMENTS

| | | | |
|---|---|---|---|
| 3,595,946 | 7/1971 | Joo et al. | 423/447.6 |
| 3,629,379 | 12/1971 | Otani | 423/447.6 |
| 3,702,054 | 11/1972 | Araki et al. | 423/447.6 |
| 3,959,448 | 5/1976 | Fuller et al. | 423/447.7 |
| 4,066,737 | 1/1978 | Romovacek | 264/29.2 |
| 4,115,527 | 9/1978 | Otani et al. | 423/447.6 |
| 4,301,135 | 11/1981 | Nazem et al. | 423/447.6 |
| 4,317,809 | 3/1982 | Lewis et al. | 264/29.2 |
| 4,320,107 | 3/1982 | Oyabu et al. | 423/447.2 |
| 4,331,620 | 5/1982 | Diefendorf et al. | 264/29.2 |
| 4,356,158 | 10/1982 | Ishikawa et al. | 264/29.2 |
| 4,376,747 | 3/1983 | Nazem | 264/29.2 |

FOREIGN PATENT DOCUMENTS

| | | | |
|---|---|---|---|
| 2457991 | 6/1975 | Fed. Rep. of Germany | 264/29.2 |
| 136835 | 8/1983 | Japan | 264/29.2 |
| 136836 | 8/1983 | Japan | 264/29.2 |

OTHER PUBLICATIONS

Singer, L. S., "The Mesophase and High Modulus Carbon Fibers from Pitch," Union Carbide Corp., Carbon Products Div., Parma Tech. Center, Parma, OH., Charles E. Pettinos Award Lecture, 13th Bicental. Conf. on Carbon, Irvine, Calif. *Carbon*, vol. 16, 1978, pp. 408-415.

*Primary Examiner*—Philip Anderson
*Attorney, Agent, or Firm*—David Fink

[57] ABSTRACT

A process of spinning a pitch having less than 40% by weight mesophase into a pitch fiber having at least 70% by weight mesophase is described.

2 Claims, 3 Drawing Figures

PHYSICAL CONVERSION OF LATENT MESOPHASE MOLECULES TO ORIENTED MOLECULES

The invention relates to mesophase pitch derived fibers and particularly, to mesophase pitch fibers.

According to the prior art, the method for producing mesophase pitch based carbon fibers comprises spinning a mesophase pitch having a mesophase content from about 40% to about 90% by weight mesophase into a pitch fiber, thermosetting the pitch fiber, and thereafter, carbonizing the thermoset pitch fiber. The prior art teaches that it is preferable to use a mesophase pitch having a mesophase content of at least about 70% by weight.

The necessity for having a mesophase content of at least 40% by weight has resulted in the definition for mesophase pitch in the art as being pitch containing at least 40% by weight mesophase.

It has been widely recognized in the art that a high mesophase content in the mesophase pitch to be spun into pitch fibers will result in a relatively high alignment of molecules oriented parallel to the fiber axis and thereby enable the production of carbon fibers having good mechanical properties.

It has now been found that it is possible to spin a pitch fiber using a novel process from a pitch having a mesophase content of less than 40% by weight and yet obtain a pitch fiber exhibiting a mesophase content exceeding 70% by weight.

In accordance with prior art, it is understood herein that the mesophase content of a pitch is measured by the use of polarized light microscopy. Generally, there are two methods by which mesophase content is known to be evaluated. One is through the use of polarized light microscopy with a hot-stage microscope. The other measurement procedure includes the steps of heating a sample of the pitch in a ceramic container for about one half hour at 350° C. and examining cross sections of the cooled pitch with a polarized light microscope. Both of these measurement procedures have in common the use of a thermal treatment and polarized light for the detection of optical anisotropic regions. Variations of these measurements are used to provide greater accuracy. These known methods also include a thermal treatment and the use of polarized light.

It has now been discovered that the known methods for measuring mesophase content do not reveal the presence of all molecules which are capable of being oriented. In particular, the molecules capable of being oriented during the process of spinning a pitch fiber are valuable to know, particularly if one can spin a pitch so that such molecules become oriented.

As used herein, the term "mesophase-type molecules" refers to molecules which form a portion of the optical anisotropic domains identified as mesophase according to prior art measurements.

As used herein, the term "isotropic-type molecules" refers to molecules forming the regions identified as optically isotropic according to prior art measurements.

As used herein, the term "latent mesophase molecules" refers to molecules which appear as isotropic-type molecules under prior art measurements but are capable of being oriented under spinning conditions according to the instant invention.

As used herein, the term "preferred orientation" is used in accordance with its meaning in the art and refers to the relative alignment of molecules with respect to each other to define domains. In particular, the preferred orientation for pitch fibers is generally parallel to the pitch fiber axis.

One of the surprising discoveries related to the instant invention is that measurements can be made on a pitch to enable an estimate to be made for the total relative amount of mesophase-type molecules and latent mesophase molecules.

In its broadest embodiment, the instant invention comprises selecting a petroleum-derived or a coal-derived pitch having a mesophase content of less than 40% by weight according to conventional measurements and having a total content of mesophase-type molecules and latent mesophase molecules greater than 70% by weight; and spinning the pitch into a fiber having a diameter less than about 60 microns, while subjecting the pitch to a flow deformation and deformation rate to produce a pitch fiber having at least 70% mesophase by weight.

The invention further includes thermosetting the pitch fiber and carbonizing the thermoset pitch fiber. The thermosetting of the pitch fiber is carried out using suitable conditions in accordance with the prior art. In this respect, care must be used to avoid elevated temperatures which could raise the temperature of the pitch fiber to a temperature at which the oriented latent mesophase molecules can become disoriented. Suitable thermosetting processes are known in the art. The carbonizing step can be carried out in accordance with the prior art.

The measurement of the total amount of mesophase-type molecules and latent mesophase molecules can be carried out using a solvent extraction procedure. The solvent extraction procedure is used only as a measurement procedure and not to produce a new precursor pitch or to modify the pitch to be spun.

U.S. Pat. No. 4,208,267 relates to a process for making mesophase pitch comprising generally solvent extracting a pitch using a solvent such as toluene, recovering the insoluble portion, and thereafter, heating the insoluble portion to convert it into a mesophase pitch.

It has now been discovered that the solvent in this process removes low weight molecules which tend to inhibit the orientation of molecules during the measurement of the mesophase content using a thermal step. In addition, it has now been realized that the insoluble portion obtained by the solvent extraction comprises mesophase-type molecules and latent mesophase molecules so that the solvent extraction step can be used for estimating the total quantity of these molecules with respect to the original sample of the pitch.

The composition of the insoluble portion resulting from the solvent extraction depends upon the solvent used and the temperature at which the solvent extraction is carried out. For example, solvent extraction with a strong solvent can result in a portion of the desired molecules being dissolved so that the insoluble portion obtained does not substantially represent the total quantity of mesophase-type molecules and latent mesophase molecules. This can be appreciated for a solvent extraction measurement which results in 50% by weight of insolubles with respect to the pitch used and the mesophase content of the insoluble portion as measured according to the prior art amounts to 100% by weight mesophase. For this choice of the solvent extraction condition, there is the possibility that the insoluble portion does not include all of the mesophase-type molecules and latent mesophase molecules to the extent that a good estimate can be made. In this case, the total mesophase-type molecules and latent mesophase molecules with respect to the pitch would be estimated at being at least about 50% by weight.

In order to improve the accuracy of the measurement of the amount of mesophase-type molecules and latent mesophase molecules for the above case, the solvent extraction process should be carried out with a weaker solvent. This should result in a larger amount of insolubles. Preferably, the solvent extraction used should result in an insoluble portion which has a mesophase content as measured according to the prior art in an amount less than 100% by weight and preferably greater than about 90% by weight. This increases the likelihood that all of the mesophase-type molecules and latent mesophase molecules are present in the insoluble portion and minimizes the detrimental effect of the non-mesophase portion.

The amount of the latent mesophase molecules in a pitch can be increased substantially by subjecting the pitch to a thermal heat treatment with or without sparging in accordance with known methods for converting isotropic pitch into a mesophase pitch. Significantly, for the instant invention it is not necessary to carry out the thermal treatment to a great extent because the instant process converts latent mesophase molecules into oriented molecules whereas prior art spinning processes only converted a minor portion of the latent mesophase molecules into oriented molecules.

The pitch to be used in carrying out the instant invention must meet the criteria of less than 40% by weight mesophase as measured according to the prior art and contain mesophase-type molecules and latent mesophase molecules amounting to at least 70% by weight as measured by solvent extraction.

The orientation of the latent mesophase molecules during the spinning according to the instant invention is achieved by the establishment of a suitable flow deformation and deformation rate. The means for establishing flow deformation and deformation rate for substantially converting the latent mesophase molecules into oriented molecules during the spinning comprises a porous body.

As used herein, a "porous body" is a body possessing tortuous paths and is capable of maintaining its structural integrity under the conditions of temperature and pressure during the spinning of the pitch into a pitch fiber. Preferably, the porous body is a porous metal body. Methods of making porous bodies of various porosities are known. The porous body can also be a porous ceramic or the like.

A porous body can be an element separate from the spinning apparatus and combined into the spinning apparatus or the porous body can be formed within the spinneret to become an integral part of the spinneret by the use of known methods.

Generally, the minimum thickness of the porous body as measured in the direction of a flow path should be sufficient to establish the needed flow deformation and deformation rate.

The maximum thickness of the porous body in the direction of the flow path is somewhat related to the cross-sectional area of the porous body. The maximum thickness is determined by the pressure needed to pass the pitch being spun to produce the pitch fiber. It is essential that the porous body be positioned in the spinneret channel through which the pitch flows to form the pitch fiber. As used herein, the "spinneret channel" is the last channel in the spinneret through which the pitch passes during the spinning of the pitch fiber.

Generally, for a short spinneret channel, the particle size for the porous metal body should be greater than about 10 microns with 30 volume % voids.

For a long channel, the particle size for the porous metal body should be in the range of about 100 to about 200 mesh with about 60 volume % voids. Generally, the particle size for the porous metal body should be from about 5% to about 30% of the diameter of the exit side of the spinneret channel.

Preferably, the porous metal body should be made in situ in the spinneret channel using prior art methods.

Preferably, the porous body is a porous metal body made from 100/150 mesh particles having a size of about 0.007 inch. The porous metal body comprises about 80% by weight nickel and about 20% by weight chromium. The bonds between particles are about 10% of the particle size and pack to 60% volume with 45 microns average pore size. All of the pores are essentially open pores.

In the preferred embodiment, the invention relates to a process of producing a continuous pitch fiber and features the steps of selecting a coal-derived or petroleum-derived pitch having a mesophase content of less than 40% by weight according to prior art measurements and having a total content of mesophase-type molecules and latent mesophase molecules of greater than about 70% by weight, and spinning a pitch fiber having a diameter of less than about 30 microns from the pitch by passing the pitch through a porous body positioned in a spinneret channel defined between the inside and outside surfaces of a spinneret, whereby the pitch fiber comprises at least 70% mesophase by weight.

For a fuller understanding of the nature and objects of the invention, reference should be had to the following detailed description, taken in connection with the accompanying drawings in which.

In carrying the invention into effect, certain embodiments have been selected for illustration in the accompanying drawings and for description in the specification. Reference is had to the drawings.

Figure 1:
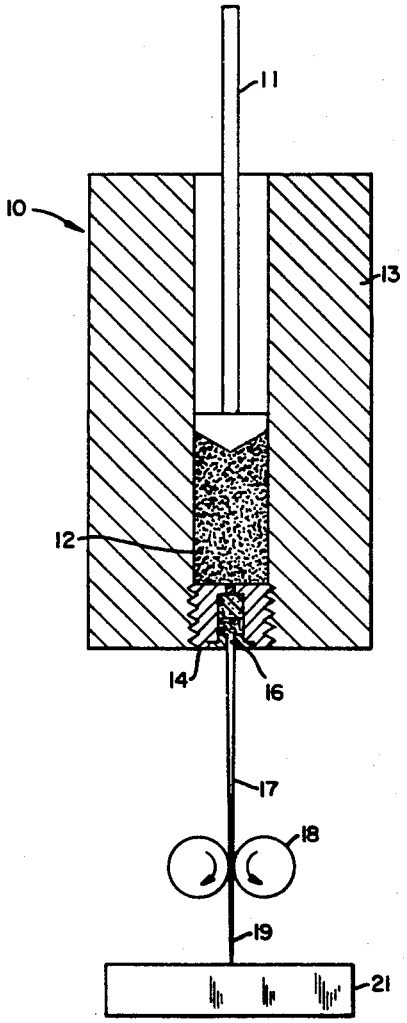
FIG. 1 shows a simplified apparatus, partially in section, as one embodiment for carrying out the instant invention.

FIG. 1 shows a simplified spinning apparatus 10 for producing a pitch fiber. A piston 11 applies pressure to pitch 12 in a reservoir 13. The reservoir 13 is maintained at a temperature above the softening point of the pitch by heating means not shown, in accordance with conventional practice.

The pitch 12 passes through a spinneret or outlet means 14 which includes a spinneret channel 16 and forms a pitch fiber 17 . The channel 16 extends from the inside to the outside of the spinneret or outlet means 14.

Typical simple spinning apparatuses include rollers 18 for drawing down the pitch fiber 17 to produce a drawn pitch fiber 19. A tray 21 is used to collect the pitch fiber 19.

For the spinning apparatus 10, the piston 11 is moved downward at a speed of about 0.6 centimeters per minute and the pitch fiber 19 has a diameter of less than about 30 microns. Preferably, the plunger speed and/or the diameter of the channel 16 as well as the draw down can be modified in accordance with the prior art to obtain pitch fibers having diameters from about 20 microns to about 30 microns, the preferred range.

The pitch fiber 19 can be thermoset using known methods and care to avoid disrupting the oriented molecules.

Figure 2:
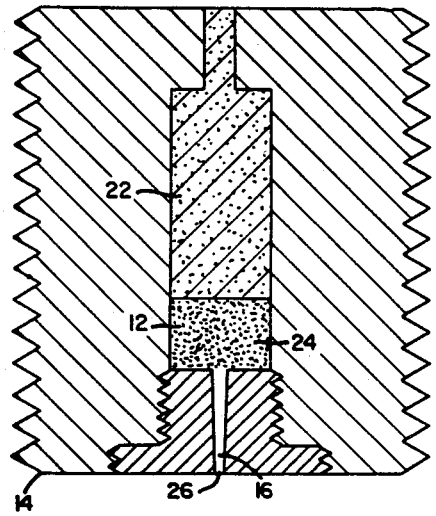
FIG. 2 shows the outlet means of FIG. 1 on an enlarged scale.

A porous body 22 of porous metal as shown in FIG. 2 establishes a flow deformation and deformation rate necessary for converting the latent mesophase molecules to oriented molecules during the spinning of the pitch fiber 19. FIG. 2 shows the porous body 22 positioned in the spinneret channel 16 spaced away from the exit opening 26 of the channel.

The porous body 22 is porous metal prepared in situ within the outlet means 14 in accordance with the prior art such as U.S. Pat. No. 3,831,258. Space 24 which is shown to contain pitch 12 arises due to the shrinkage of the materials used during the formation of the porous body 22. The porous body 22 was prepared using 100/150 mesh particles having a size of about 0.007 inch and made of about 80% by weight nickel and about 20% by weight chromium. The particles are irregular shaped particles and the bonds between particles were about 10% of the particle sizes. The particles packed to about 60 volume % with pores of 45 microns on the average. Essentially, all of the pores of the porous body 22 were open pores. Open pores are essential to pass the pitch through the spinneret channel 16 .

Figure 3:
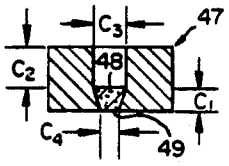
FIG. 3 shows on an enlarged scale a preferred embodiment of a portion of the outlet means for carrying out the invention.

FIG. 3 shows outward means 47 which is another embodiment and which was used in the example. Porous body 48 has the same composition as porous body 22 and is positioned in the conical portion near exit opening 49 of the spinneret channel. The pertinent dimensions of the outlet means 47 are as follows:

$C_1$ is about 0.20 inch, $C_2$ is about 0.40 inch, $C_3$ is about 0.25 inch, and $C_4$ is about 0.020 inch. The conical angle of the orifice 49 is about sixty degrees.

An illustrative, non-limiting example of the invention is set out below. Numerous other examples can readily be evolved in the light of the guiding principles and teachings herein. The example given herein is intended to illustrate the invention and not in any sense to limit the manner in which the invention can be practiced.

EXAMPLE

A pitch was selected for use in carrying out the process of the invention. The pitch was a petroleum pitch which had been subjected to a thermal treatment at a temperature of about 400° C. with sparging in accordance with conventional practice for converting a pitch into a mesophase pitch. The thermal treatment was discontinued well before a substantial conversion of the pitch into mesophase took place. This was based on prior experiments with the conversion of the pitch into a mesophase pitch.

The treated pitch was tested to determine the mesophase content. This test was carried out using thermal annealing in a ceramic container in accordance with prior art methods.

The estimated mesophase content according to these measurements was about 30 percent by weight.

A portion of the thermally treated pitch was then taken for the evaluation of the contents of mesophase-type molecules and latent mesophase molecules. For this test, solvent extraction was carried out with toluene at a temperature of 25° C., using a ratio of one gram pitch to ten milliliters of toluene. The mixture was stirred one hour and the insoluble portion amounted to about 78% by weight yield with respect to the thermally treated pitch. The mesophase content according to conventional methods was found to be 90% by weight in the insolubles.

It was concluded that the contents of the mesophase-type molecules and the latent mesophase molecules was at least about 70% by weight with respect to the thermally treated pitch.

A pitch fiber was spun using an apparatus similar to the simplified spinning apparatus 10 shown in FIG. 1, with an outlet means 47 as shown in FIG. 3. The thermally treated pitch had a softening point of about 299° C. and the spinning temperature was about 18° C. higher. The fiber was drawn down to obtain a pitch fiber having a diameter of about 20 microns.

Measurements were made on the pitch fiber to determine the mesophase content on the basis of the optically anisotropic regions in cross sections of the pitch fiber without the use of a thermal step because the thermal step is not needed in order to make the evaluation.

The pitch fiber was determined to contain about 90% by weight mesophase. This result indicates that the contents of the mesophase-type molecules and latent mesophase molecules was much higher than what was determined in the solvent extraction test carried out. This discrepancy can be explained as follows. For the solvent extraction test the insoluble portion was measured to contain about 90% mesophase. The presence of low weight molecules remaining in the insoluble portion resulted in the mesophase content according to prior art measurements to be about 90% by weight. If the solvent extraction test were repeated using a stronger solvent system, perhaps the same solvent but a higher temperature, it is expected that the insoluble portion would be a lower weight percent, but would contain fewer low weight molecules. A higher weight percent of mesophase would be obtained so that the calculated contents for the mesophase-type molecules and latent mesophase molecules in the thermally treated pitch would amount to a higher number than the estimated 70% by weight.

Having thus described the invention, what we claim as new and desire to be secured by Letters Patent, is as follows:

1. A pitch fiber having at least 70% mesophase by weight is produced from a spinneret by the steps comprising selecting a petroleum-derived or coal-derived pitch having a mesophase content of less than 40% by weight according to conventional measurements and having a total content of mesophase-type molecules and latent mesophase molecules greater than 70% by weight; and spinning the pitch into a fiber having a diameter less than about 60 microns by passing said pitch through a porous body positioned in a spinneret channel defined between the inside and outside surfaces of said spinneret to produce said pitch fiber.

2. A process for producing a continuous pitch fiber having at least 70% mesophase by weight from a spinneret, comprising the steps of selecting a coal-derived or petroleum-derived pitch having a mesophase content of less than 40% by weight according to conventional measurements and having a total content of mesophase-type molecules and latent mesophase molecules greater than 70% by weight; and spinning the pitch into a fiber having a diameter less than about 30 microns by passing said pitch through a porous body positioned in a spinneret channel defined between the inside and outside surfaces of said spinneret.

* * * * *